US005100512A

United States Patent [19]

Waters

[11] Patent Number: 5,100,512

[45] Date of Patent: Mar. 31, 1992

[54] DANDY ROLL HAVING A TWILL WEAVE WIREMARK AND RELATED METHOD FOR PAPERMAKING

[75] Inventor: James R. Waters, Ellenton, Fla.

[73] Assignee: The Mead Corporation, Dayton, Ohio

[21] Appl. No.: 580,903

[22] Filed: Sep. 11, 1990

[51] Int. Cl.[5] ..... D21F 1/46

[52] U.S. Cl. ..... 162/110; 162/357; 29/121.3

[58] Field of Search ..... 162/110, 357, 116, 117, 162/111, DIG. 1, 140; 29/121.3

[56] References Cited

U.S. PATENT DOCUMENTS

| | | | |
|---|---|---|---|
| 3,230,136 | 1/1966 | Krake | 162/116 |
| 3,905,863 | 9/1975 | Ayers | 162/116 |
| 4,526,652 | 7/1985 | Waters | 29/121.3 |

FOREIGN PATENT DOCUMENTS

| | | | |
|---|---|---|---|
| 1447933 | 7/1976 | United Kingdom | 162/110 |

*Primary Examiner*—Kenneth M. Schor
*Assistant Examiner*—Brenda Lamb
*Attorney, Agent, or Firm*—Thompson, Hine and Flory

[57] ABSTRACT

Paper having an unique twill weave wiremark produced using a dandy roll in which the outer screen bears has a twill weave; the dandy roll and the papermaking process are also disclosed.

8 Claims, 1 Drawing Sheet

DANDY ROLL HAVING A TWILL WEAVE WIREMARK AND RELATED METHOD FOR PAPERMAKING

BACKGROUND OF THE INVENTION

1. Field of the Invention

The present invention relates to a dandy roll useful in producing paper having a twill weave wiremark pattern.

2. Description of Prior Art

In papermaking, watermarks are conventionally formed by contacting the paper stock while it is still damp with a dandy roll having raised and/or recessed areas on the surface. An opaque mark known as a "shaded mark" is formed on the paper in areas contacting the recesses on the surface of the dandy roll and is the result of pulp fibers accumulating in the recesses as the paper stock travels under the dandy roll on the papermaking machine. Translucent marks, known as "wire marks," are formed in the paper in areas contacting the raised areas on the surface of the dandy roll. These marks are the result of the raised surface of the roll displacing the fibers in the stock resulting in areas in which the fibers are less concentrated and the paper is more translucent.

It is conventional in the art to form shaded marks by depressing the surface of the wire screen forming the dandy roll and to form wire marks by soldering wire segments, known as electro wires, to the surface of the dandy roll screen. See, for example, U.S. Pat. No. 353,666 to Z. Crane, Jr. (1886) and U.S. Pat. No. 1,571,715 to Fearing (1926). It has also been known to watermark paper by altering the drainage rate of the Fourdrinier screen by modifying the weave in the screen such as by using larger gauge wire to form the screen or by omitting a wire from the screen altogether. See, for example, U.S. Pat. No. 1,616,222 to Harrigan (1927).

In a previous patent to Waters, U.S. Pat. No. 4,526,652, a papermaking process is disclosed wherein paper bearing the look of an oxford cloth weave is produced. The oxford cloth simulation is achieved by positioning narrow pockets and electrowires along the circumferential and longitudinal axis of a plain weave dandy roll screen. While the oxford cloth weave is a desirable effect, other aesthetic effects are also desirable.

By departing from the plain weave dandy roll screen in favor of a twill weave screen, a different aesthetic effect can be achieved. More specifically, the twill weave screen of the present invention imparts more of a "box-like" effect than that of the plain weave dandy roll screen.

SUMMARY OF THE INVENTION

An object of the present invention is to provide a dandy roll which is useful in manufacturing paper bearing a twill weave wiremark pattern.

A further object of the present invention is to provide a process for producing paper which carries a twill weave wiremark pattern.

Still a further object of the invention is to provide a paper having a twill weave wiremark.

These and other objects of the present invention will become apparent from the following description of the invention.

DETAILED DESCRIPTION OF THE INVENTION

A paper bearing a twill weave wire mark produced in accordance with the present invention exhibits a background of woven translucent lines. In addition to the simulated weave, the paper may bear one or more conventional watermarks such as the name of a paper manufacturer, a company logo, or the like.

Figure 4:
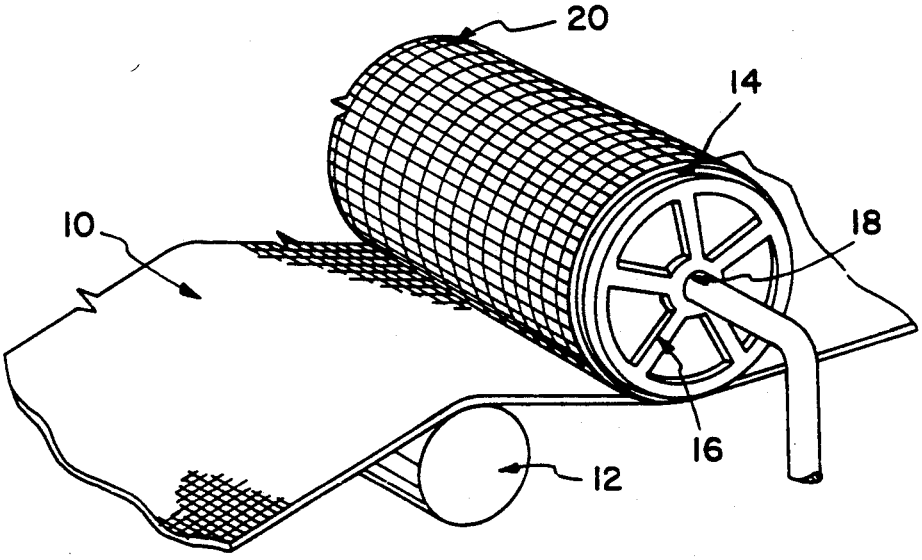
FIG. 4 is a perspective view of a dandy roll in accordance with the present invention on a conventional papermaking machine.

The dandy roll of the present invention is used in conjunction with standard papermaking techniques. The dandy roll is usually positioned near the end of the papermaking machine where the paper stock leaves the wire, as is conventional in the art. At this point, the paper stock is sufficiently damp that the fibers forming the paper can be displaced by the surface of the dandy roll. A typical arrangement is shown in FIG. 4. The paper web 10 is supported on a table of rollers 12 as it passes into contact with the dandy roll 14.

The dandy roll is constructed of a cylindrical frame which is wrapped with two wire mesh covers (one shown). The frame is constructed in a conventional manner. To provide rigidity, a large diameter spiral truss wire (not shown) is wound in either clockwise or counter-clockwise direction between two bronze spidered heads 16 (one shown) on each end of the Dandy roll. Longitudinal braces (not shown) are typically welded across the length of the roll between the spidered heads. Each spidered head 16 has a journal 18 protruding from its center which holds the dandy roll in place on the papermaking machine. These journals are not necessary if the dandy roll is mounted with a trunnion drive. In this case, the dandy heads are not spidered but have concave groove around each open head which matches the trunnion drive wheel. An inner wire cover (not shown) is then spirally wound around the circumference of the roll in the direction opposite the windings of the truss wire. The inner wire cover may have a conventional plain weave with the shute wires being one over and one under the warp wires. The mesh size may vary from as open as 10 mesh per inch to as closed as 24 mesh per inch. The outer wire mesh cover 20, that which will come in contact with the paper, is affixed to the cylindrical frame by soldering to the spidered heads and seaming the edges of the screen across the length of the roll.

Figure 1:
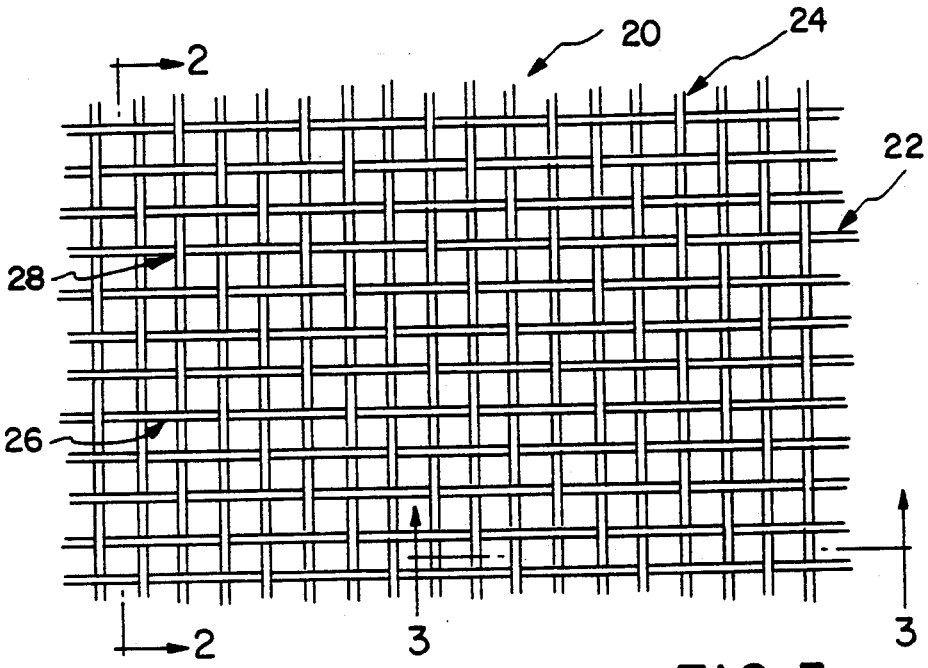
FIG. 1 is an overhead view of a dandy roll screen in accordance with the present invention.
Figure 2:
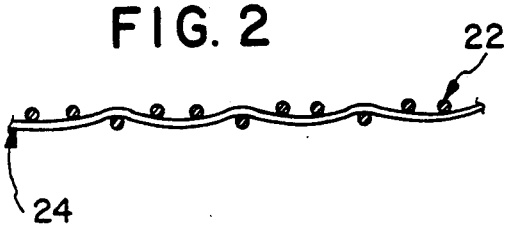
FIG. 2 is a horizontal view of a shute wire along the widthwise axis of the dandy roll screen.
Figure 3:
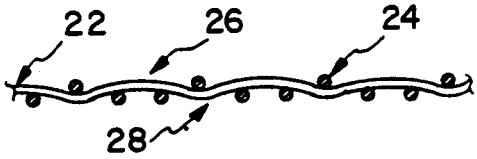
FIG. 3 is a horizontal view of a warp wire along the lengthwise axis of the dandy roll screen.

The outer wire mesh cover 20 of FIG. 1 comprises length wise warp wires 22 and width wise shute wires 24 woven in a twill weave pattern. This is a deviation from standard practice whereby the outer wire mesh cover is woven in a conventional plain weave design. To produce the twill weave pattern of the present invention, the outer wire mesh cover is woven with the shute wires 24 being one over then two under the warp wires 22. A screen woven in this fashion exhibits long warped knuckles 26 on one face and short warped knuckles 28 on the opposing face. In FIG. 3, long warp knuckles 26 are defined as lengthwise warp wires 22 passing over two consecutive width-wise shute wires 24. Short warp knuckles 28 are defined as lengthwise warp wires passing over individual width-wise shute wires.

It has previously been known to construct the paper machine wire (not the dandy roll) with a twill weave. This was done to increase the life of the paper machine wire. The short warp knuckles were placed adjacent the paper in order to minimize screen wear.

In accordance with the preferred embodiments of the present invention, the outer wire mesh cover is affixed to the dandy roll with the long warped knuckles facing the paper. The long warp knuckles make an impression on the paper surface in this manner.

In accordance with preferred embodiments of the present invention, the outer screen mesh size ranges from between 4 to 9 mesh per inch and the outer screen wire diameter is about 0.016 to 0.018 inches and preferably about 0.017 inches. Standard wire diameters for a conventional dandy roll screen with a mesh range of 4 to 9 ranges between 0.045 to 0.027 inches.

Having described the invention in detail and by reference to preferred embodiments thereof, it will be apparent that modifications and variations are possible without departing from the scope of the invention defined in the appended claims.

What is claimed is:

1. A dandy roll comprising an outer screen for imparting a wiremark to paper, said outer screen being mounted upon a cylindrical frame formed by an inner cylindrical screen fixed between a pair of circular spindle heads, said outer screen being formed of warp wires and shute wires woven in a one over and two under pattern having a long warp knuckle on a paper facing side of said screen and a short warp knuckle on the opposite side of said screen, said outer screen having a mesh range of about 4 to 9 mesh per inch.

2. The dandy roll of claim 1 wherein said outer screen is formed from approximately 0.017 inch diameter wire.

3. A paper making process which comprises contacting damp paper stock with a dandy roll to form a wire mark in said stock, said dandy roll comprising an outer screen being counted upon a cylindrical frame formed by an inner cylindrical screen fixed between a pair of cylindrical spindle heads, said outer screen being formed of warp wires and shute wires woven in a one over and two under pattern having a long warp knuckle on a paper facing side of said screen and a short warp knuckle on the opposite side of said screen, said outer screen having a mesh range of about 4 to 9 mesh per inch.

4. The paper making process of claim 3 wherein said outer screen is formed from approximately 0.017 inch diameter wire.

5. A dandy roll comprising an outer screen for imparting a wiremark to paper, said outer screen being mounted upon a cylindrical frame formed by an inner cylindrical screen fixed between a pair of circular spidered heads, said outer screen being formed of wires having a twill weave such that said screen includes a long warp knuckle on a paper facing side of said screen and a short warp knuckle on the opposite side of said screen and being about four to nine mesh.

6. The dandy roll of claim 5 wherein said outer screen is formed from approximately 0.017 inch diameter wire.

7. A paper making process which comprises contacting damp paper stock with a dandy roll to form a wiremark in said stock, said dandy roll comprising an outer screen being mounted upon a cylindrical frame formed by an inner cylindrical screen fixed between a pair of cylindrical spidered heads, said outer screen being formed of wires having at will weave such that said screen includes a long warped knuckle on a paper facing side of said screen and a long shute knuckle on the opposite side of said screen and being about four to nine mesh.

8. The paper making process of claim 7 wherein said outer screen is formed from approximately 0.017 inch diameter wire.

* * * * *